US005726643A

United States Patent [19]

Tani

[11] Patent Number: 5,726,643

[45] Date of Patent: Mar. 10, 1998

[54] RADIO PAGING RECEIVER CAPABLE OF DISPLAYING A PREDETERMINED MESSAGE

[75] Inventor: Hiroaki Tani, Tokyo, Japan

[73] Assignee: NEC Corporation, Tokyo, Japan

[21] Appl. No.: 368,399

[22] Filed: Jan. 3, 1995

Related U.S. Application Data

[63] Continuation of Ser. No. 866,468, Apr. 10, 1992, abandoned.

[30] Foreign Application Priority Data

Apr. 12, 1991 [JP] Japan ..... 3-106568

[51] Int. Cl.[6] ..... G08B 5/22

[52] U.S. Cl. ..... 340/825.44; 455/38.4

[58] Field of Search ..... 340/825.44, 311.1; 455/38.4; 379/57

[56] References Cited

U.S. PATENT DOCUMENTS

| | | | |
|---|---|---|---|
| 4,383,257 | 5/1983 | Giallanza | 340/825.44 |
| 4,706,272 | 11/1987 | Nishimura | 340/825.44 |
| 4,839,628 | 6/1989 | Davis et al. | 340/825.44 |
| 4,870,403 | 9/1989 | Mori et al. | 340/825.44 |
| 5,025,252 | 6/1991 | DeLuca et al. | 340/825.44 |
| 5,331,317 | 7/1994 | Davis | 340/825.44 |

FOREIGN PATENT DOCUMENTS

| | | |
|---|---|---|
| A0135783 | 4/1985 | European Pat. Off. . |
| A0360228 | 3/1990 | European Pat. Off. . |
| WO-A8809104 | 11/1988 | WIPO . |

*Primary Examiner*—Brian Zimmerman

*Attorney, Agent, or Firm*—Sughrue, Mion, Zinn, Macpeak & Seas, PLLC

[57] ABSTRACT

In a radio paging receiver, a CPU selects (SA3) from call signals a specific call signal specific to the receiver and from message signals a specific message signal that follows the specific call signal and represents a specific message, which is displayed (SA23) on a display. The CPU judges (SA20) whether or not the specific message is identical with a predetermined message. An EEPROM memorizes (SA21) an inhibit signal when the specific message is identical with the predetermined message. The CPU puts (SA23–SA25) the receiver out of operation when the EEPROM memorizes the inhibit signal. The CPU makes (SA23) the display display the predetermined message when the EEPROM memorizes the inhibit signal.

3 Claims, 5 Drawing Sheets

RADIO PAGING RECEIVER CAPABLE OF DISPLAYING A PREDETERMINED MESSAGE

This is a continuation of application Ser. No. 07/866,468 filed Apr. 10, 1992, now abandoned.

BACKGROUND OF THE INVENTION

This invention relates to a radio paging receiver for receiving call signals specific to the receiver one at a time and for receiving a message signal that follows each call signal to represent a message.

A conventional radio paging receiver provides various information services. For each of the information services, a service fee must be paid by an owner of the receiver. If the owner does not pay the service fee, the service has to be suspended. In order to suspend the information service, a predetermined message is sent from a control station to put the receiver out of a receiving operation for one of the call signals that follows the predetermined signal.

Such a conventional radio paging receiver is disclosed in U.S. Pat. No. 4,639,726 issued to Yoshio Ichikawa et al and assigned to the present assignee. When the radio paging receiver is supplied with electric power from an electric power supplying section, the receiver is put in the receiving operation. According to an embodiment of the Ichikawa et al patent, the radio receiver is deficient in that the receiver can not judge, when the receiver is not put in the receiving operation even after the electric power is supplied thereto, whether or not the predetermined signal is received before the electric power is once turned off and then turned on.

SUMMARY OF THE INVENTION

It is therefore an object of the present invention to provide a radio paging receiver capable of displaying a predetermined message on a display when the receiver receives a predetermined signal while electric power is turned on and subsequently turned off and then again turned on.

Other objects of this invention will become clear as the description proceeds.

On describing the gist of an aspect of this invention, it is possible to understand that a radio paging receiver comprising: receiving means for receiving a plurality of call signals and a plurality of message signals following the call signals; selecting means for selecting from the call signals a specific call signal of the call signals that is specific to the receiver and for selecting from the message signals a specific message signal that follows the specific call signal to represent a specific message; display means for displaying the specific message; judging means for judging whether or not the specific message is identical with a predetermined message; memory means for memorizing an inhibit signal when the specific message is identical with the predetermined message; first control means for controlling the receiving means to put the receiving means out of operation when the memory means memorizes the inhibit signal; and second control means for controlling the display means for display of the predetermined message on the display means when the memory means memorizes the inhibit signal.

DESCRIPTION OF THE PREFERRED EMBODIMENT

Figure 1:
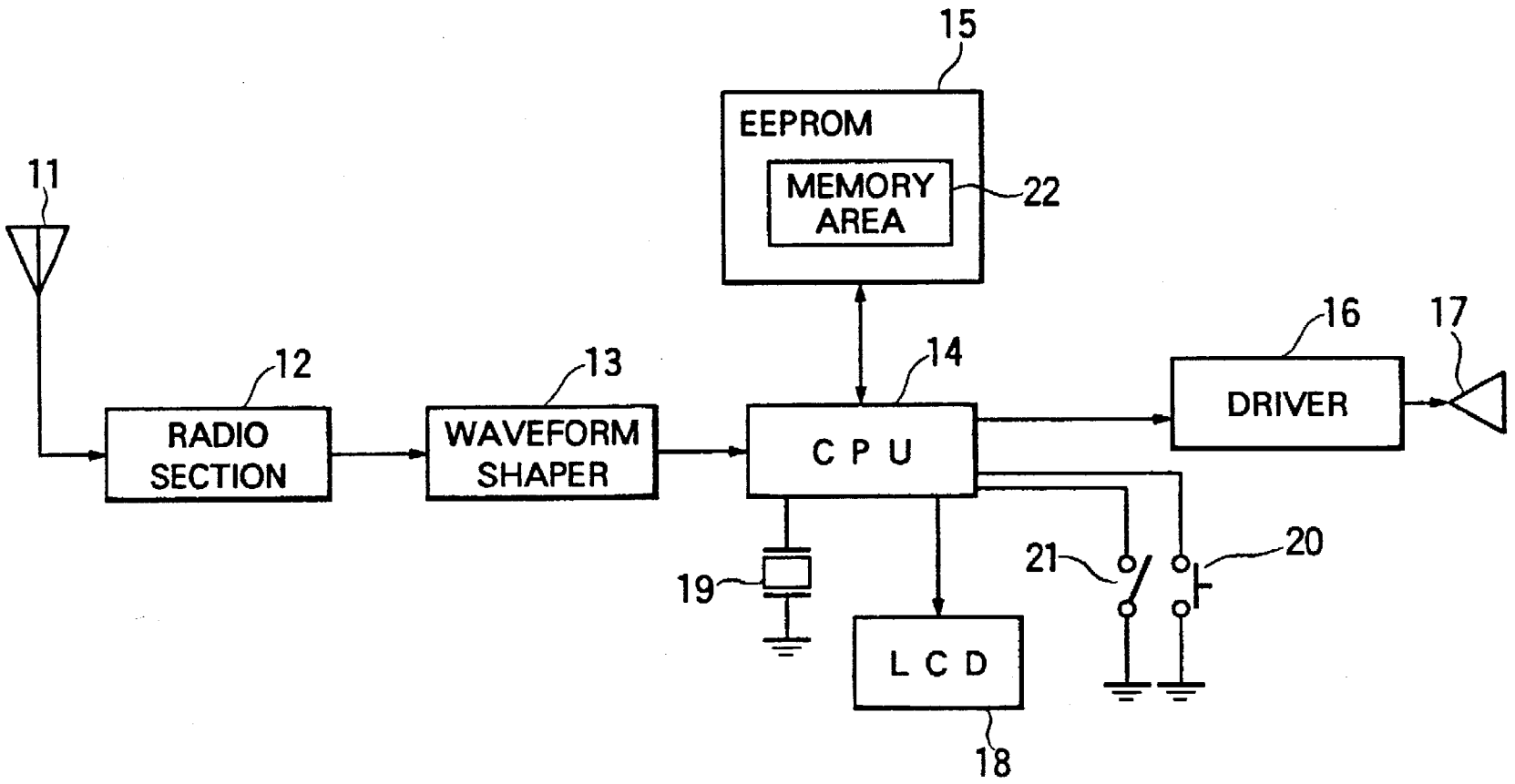
FIG. 1 is a block diagram of a radio paging receiver to which this invention is applicable.

Referring to FIG. 1, attention will be directed to a radio paging receiver according to a preferred embodiment of the present invention. The radio paging receiver is connected to an antenna 11 for receiving a radio signal as a received radio signal and to a power source (not shown). The radio signal is supplied from a control station (not shown) and carries a digital signal which will later be described more in detail.

A radio section 12 is for subjecting the received radio signal to frequency conversion, amplification, and demodulation. The radio section 12 comprises a discriminator (not shown) for producing a demodulated signal. A waveform shaper 13 is for shaping the waveform of the demodulated signal to produce a reproduction of the digital signal. The radio section 12 and the waveform shaper 13 are known in the art. For example, the radio section 12 may be of the type described in U.S. Pat. No. 4,194,153 issued to Masaru Masaki et al and assigned to the present assignee. The waveform shaper may comprise a low-pass filter and a comparator.

The reproduction of the digital signal, namely, a reproduced digital signal is supplied from the waveform shaper 13 to a CPU 14 operable in cooperation with an EEPROM (electrically erasable programmable read-only memory) 15 for memorizing a number signal representative of an identification number which is specific to the illustrated radio paging receiver. The EEPROM is furthermore for memorizing various signals as will become clear as the description proceeds.

The CPU 14 is connected to a driver circuit 16 and an LCD (liquid crystal display) unit 18. The driver circuit 16 is for making a loudspeaker 17 produce a call or beep tone. The display unit 18 is for providing a visual display. The driver circuit 16 may be an amplifier. The display unit 18 may be a twelve-digit seven-segment liquid crystal display unit. Each segment may be for displaying a seven-by-five-dot matrix. The display unit of this type can display various alphanumeric symbols, such as numerals and capital or lower-case letters.

The radio paging receiver further comprises a quartz oscillator 19 for driving the CPU 14 and a reset switch 20 for stopping the call tone and erasing the visual display. A power source switch 21 is connected to the CPU 14 to connect the power source to the CPU 14 and other elements of the receiver. In this manner, the power source switch 21 serves as a power supply arrangement.

Figure 2:
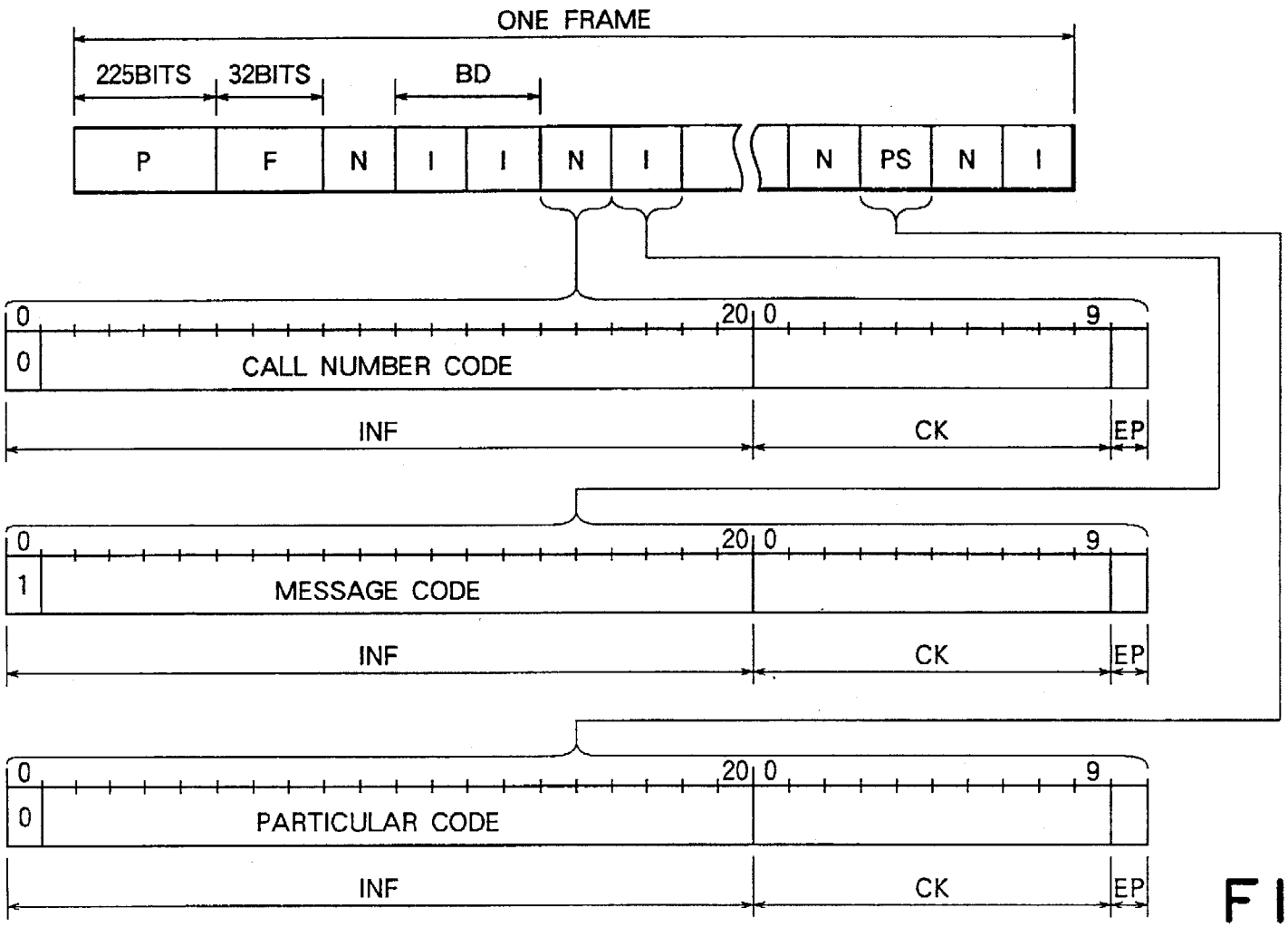
FIG. 2 is a signal format for use in describing operation of the paging receiver illustrated in FIG. 1.

Referring to FIG. 2, each frame of the radio signal carries, as depicted along a first or top row, the digital signal which comprises a preamble signal P of p bits and a frame synchronizing code F of f bits. The numbers p and f may be, for example, 225 and 32, respectively. The frame synchronizing code F appears in every frame and is followed by a plurality of call signals N and a plurality of message signals I.

Each of the call signals N represents a call or directory number code. Each of the message signals I comprises a message code. A leading one of the call signals N succeeds immediately after the frame synchronizing code F. A single one of the message signals I usually succeeds each of the call signals N. However, a message signal I may be succeeded by another message signal I as shown at a position BD. In the example being illustrated, at least one message signal I succeeds each of the call signals N.

As depicted along a second row on a large scale for one of the call signals N, the call number code is represented by an information bit part INF of twenty-one bits 0 through 20. The information bit part INF is followed by a check bit part CK of ten bits 0 through 9 and then by a parity bit part EP of one bit. In each message signal I depicted in detail along a third row, the message code is given by a similar information bit part INF which is likewise followed by a check bit part CK and thereafter by a parity bit part EP. As a result, each of the call signals N and the message signals I has a word length of thirty-two bits.

The information bit part INF and the check bit part CK of each of the call signals N and the message signals I are given by Bose-Chaudhuri-Hocquenghem (BCH) codes which are known in the art. The parity bit is for even-number parity check. A most significant bit (MSB) of each of the call signals N and the message signals I is for use in distinguishing between the call signals N and the message signals I by logic "0" for the call signals N and by logic "1" for the message signals I.

It may be mentioned here that a radio paging receiver is operable in response to a particular signal PS transmitted in the radio signal succeeding a call signal N. The particular signal PS is herein referred to alternatively as a specific message signal. Preceding the particular signal PS, the call signal N is alternatively referred to herein as a specific call signal.

As shown along a fourth or bottom row and like each of the call signals N and the message signals I, the particular signal PS consists of an information bit part INF of twenty-one bits, a check bit part CK of ten bits, and a parity bit part EP of one bit. The information bit part INF and the check bit part Ck are given by the BCH codes. The parity bit is for even number parity check.

The particular signal PS is distinguished from each message signal I by giving a logic "0" bit to the most significant bit which is common to the particular signal PS and its information bit part INF. Twenty remaining bits of the information bit part INF except the most significant bit are for use in giving one of a few kinds of particular codes. For example, one of the particular codes corresponds to a service suspension code.

In the manner described heretobefore, a service fee must be paid by an owner of the paging receiver when the owner may enjoy each of various information services. The fee may be either preliminarily paid or paid upon request from a control station for the receiver and a plurality of like radio paging receivers. When the control station detects that the owner has not paid the fee during a predetermined number of days, the control station sends a predetermined message to the receiver in question as the particular signal PS following the call signal N. The particular signal PS makes the CPU 14 put the receiver out of operation.

Figure 3:
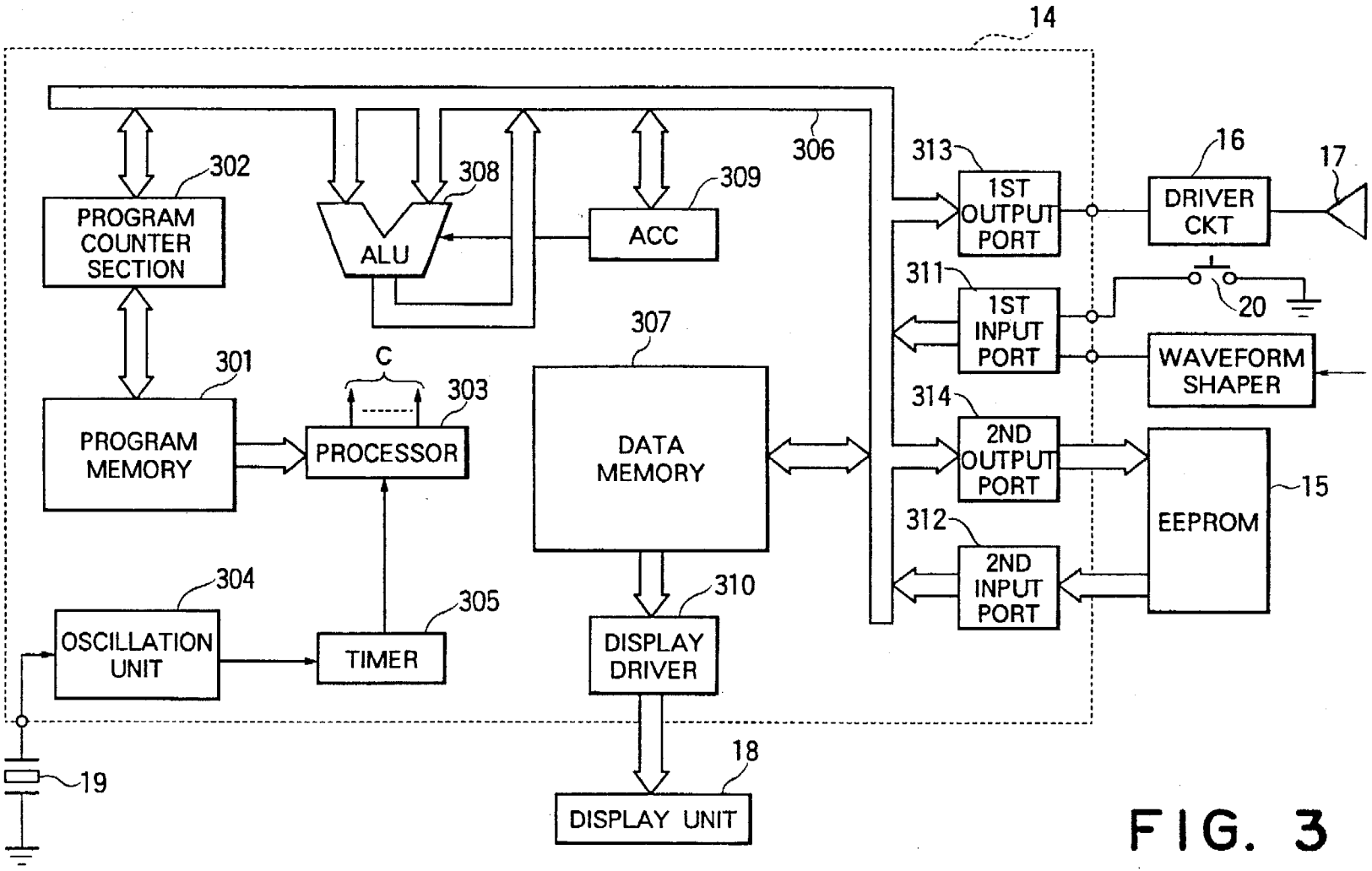
FIG. 3 is a block diagram of a CPU of the paging receiver illustrated in FIG. 1.

Referring to FIG. 3 as well as to FIG. 1, the CPU 14 is implemented as a one-chip central processing unit. The CPU 14 comprises a program memory 301 for memorizing a main program composed of a succession of instructions. In addition, a specific synchronizing pattern code is stored in the program memory 301 to detect the frame synchronizing code F (FIG. 2). The specific synchronizing pattern code has the same pattern as the frame synchronizing code F.

The main program comprises a partial program which is necessary to receive the specific call signal N specific to the receiver and to receive the specific message signal I which succeeds the specific call signal. It is to be noted here that the program memory 301 memorizes, in addition to the main program, a particular program for defining by a succession of instructions a suspending operation which should be carried out after the particular signal PS is received by the CPU 14 next succeeding the specific call signal. Briefly stated, the particular program is for inhibiting the receiving operation for the call signal which is specific to the receiver and follows the particular signal.

A program counter section 302 is coupled to the program memory 301 for use in accessing the program memory 301 by an address signal, namely, by a content of the program counter section 302 which is usually counted up by one at every instruction but sometimes rewritten by particular instructions, such as jump instructions and the like.

At any rate, the program memory 301 produces the instructions, the synchronizing pattern code, and display data. The display data correspond to a combination of the message code and the particular code stored in the memory 301 in accordance with the address signal kept in the program counter section 302.

Responsive to the instructions, a processor 303 is put into operation to deliver various kinds of control signals C to structural elements of the CPU 14 in synchronism with a clock pulse sequence which is described in the following.

In order to supply the clock pulse sequence to the processor 303, the CPU 14 comprises an oscillation unit 304 connected to the quartz oscillator 19 located outside of the CPU 14 and a timer 305 connected between the oscillation unit 304 and the processor 303.

The program counter section 302 is coupled through a data bus 306 to a data memory 307. As a result, the address signal kept in the program counter section 302 can be delivered to the data memory 307 under control of the processor 303. Additionally, the program counter section 302 is supplied with a jump address signal indicative of a jump address through the data bus 306. An arithmetic logic unit (ALU) 308 and an accumulator (ACC) 309 are coupled to the data bus 306 to cooperate in executing each instruction as will become clear as the description proceeds.

The CPU 14 comprises a display driver 310 between the data memory 307 and the display unit 18. The display driver 310 is driven in a manner to be described so as to provide the visual display on the display unit 18.

The data bus 306 is coupled to first and second input ports 311 and 312 connected to the waveform shaper 13 and to the EEPROM 15, respectively. The data bus 306 is coupled furthermore to first and second output ports 313 and 314 connected to the driver circuit 16 and the EEPROM 15, respectively. The first input port 311 is additionally coupled to the reset switch 20.

Figure 4:
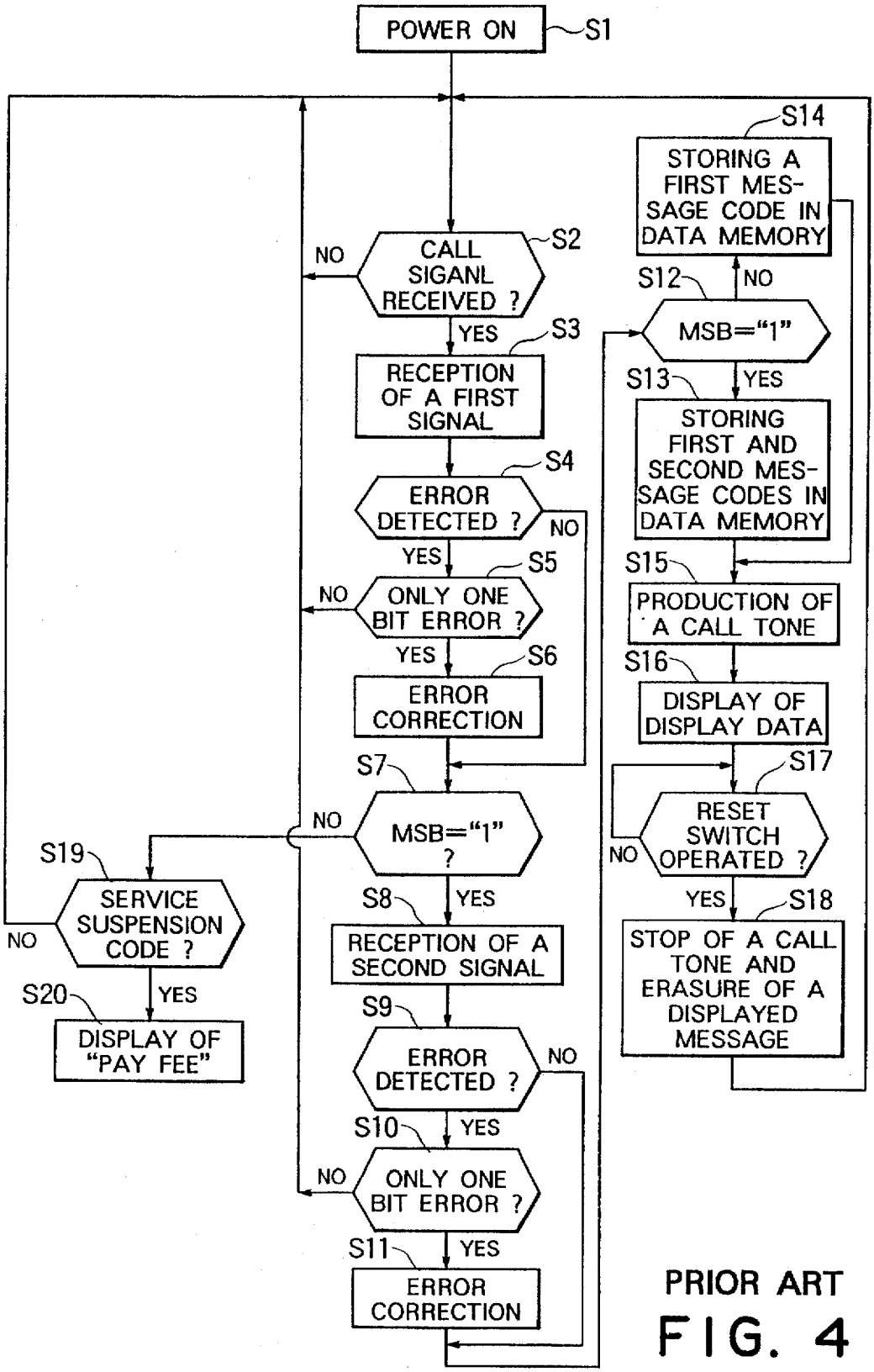
PRIOR ART FIG. 4
FIG. 4 is a flow chart for use in describing operation of a conventional paging receiver.

Referring to FIG. 4 together with FIGS. 1, 2, and 3, the description will proceed to operation of the above-mentioned embodiment of the Ichikawa et al patent, which is similar in structure to the receiver illustrated with reference to FIG. 1. The receiver is energized into an initial state when the power source switch 21 is closed at a first stage S1. The first stage S1 proceeds to a second stage S2 at which operation is carried out to detect whether or not the call signal is specific to the receiver or assigned to the receiver as an assigned call signal. When the assigned call signal is received, the second stage S2 is followed by a third stage S3. Otherwise, the pager receiver returns to the initial stage S1.

In order to detect the assigned call signal, namely, an assigned call number code at the second stage S2, the CPU 14 carries out the receiving operation of selectively receiving the assigned call signal. More specifically, the EEPROM 15 is accessed under the control of the partial program stored in the program memory 301 so as to derive the number signal representative of the identification number mentioned before. The number signal is compared by the use of the arithmetic logic unit 308 with a received call signal sent through the first input port 311 to detect the assigned call signal. Thus, elements and parts operable in cooperation with the partial program may be referred to as a receiving section and is a combination of the program memory 301, a part of the processor 303, and the arithmetic logic unit 308.

At the third stage S3, reception operation is carried out to receive a single word succeeding the assigned call signal. Such a single word may be either the message signal I (shown along the third row of FIG. 2) or the particular signal PS (shown along the bottom row). The single word will be referred to as a first one of additional signals that is identical with either the message signal I or the particular signal PS. The third stage S3 is executed under the control of the partial program. The first additional signal is sent to the accumulator 309.

A fourth stage S4 follows the third stage S3 to detect presence or absence of an error by the use of the parity bits in a usual manner. If the error is present in the first additional signal, error correcting operation is carried out in fifth and sixth stages S5 and S6. Specifically, when a single error is detected in the fifth stage S5, the error is corrected in the sixth stage S6. Otherwise, the fifth stage S5 proceeds to the initial state into which the receiver is put in the first stage S1. The above-mentioned error correcting operation is possible by the use of the BCH codes in a well-known manner.

Either of the fourth and the sixth stages S4 and S6 is followed by a seventh stage S7 at which judgement is made as regards the most significant bit of the first additional signal. If the most significant bit has a logic "1" level, the seventh stage S7 is followed by an eighth stage S8. In this event, the first additional signal carries a first message code as mentioned before and may be named a first message signal. Otherwise, the seventh stage S7 is succeeded by a nineteenth stage S19 as will later be described in detail. The above-mentioned judgement of the most significant bit of the first additional signal is made by the use of the arithmetic logic unit 308 under the control of the particular program stored in the program memory 301.

For the time being, let it be presumed that the most significant bit of the first additional signal has the logic "1" level. Under the circumstances, the seventh stage S7 is succeeded by an eighth stage S8 at which a second one of the additional signals is received under control of the particular program. The second additional signal is stored in the accumulator 309 and will later become clear.

The second additional signal is processed at ninth through eleventh stages S9 to S11 in a manner similar to the first additional signal. In other words, the ninth through the eleventh stages S9 to S11 are similar to the fourth through the sixth stages S4 to S6, respectively. Either the ninth stage S9 or the eleventh stage S11 is succeeded by a twelfth stage S12 for judging the most significant bit of the second additional signal. The logic "1" level of the most significant bit indicates that the second additional signal conveys a second message code like the first additional signal. In this event, the second additional signal may be named a second message signal. The second message signal is kept in the accumulator 309.

When the most significant bit of the second additional signal has the logic "1" level, both of the first and the second message codes of the first and the second message signals are stored in a data area of the data memory 307 at a thirteenth stage S13. When the most significant bit of the second additional signal has the logic "0" level, the second additional signal is not a message signal. That is to say, absence of any message signal is indicated by the logic "0" level of the second additional signal. In this case, only the first message code of the first message signal is detected at the seventh stage S7 and is stored in the data area of the data memory 307 at a fourteenth stage S14.

Each of the first and the second message signals has the message code of five digits at maximum, as mentioned before. Each message code is stored in the data memory 307 as display data.

After storage of the display data in the data memory 307, the processor 303 produces a drive signal as one of the control signals C. The driver circuit 16 makes the loudspeaker 17 produce the call tone in response to the drive signal at a fifteenth stage S15.

At a sixteenth stage S16, the display driver 310 drives the display unit 18 to provide the visual display corresponding to the first message code and/or the second message code in response to the drive signal. After the sixteenth stage S16, a seventeenth stage S17 is carried out so as to judge whether or not the reset switch 20 is closed.

When the reset switch 20 is closed, the call tone is stopped and the displayed message is erased at an eighteenth stage S18. As a result, the radio paging receiver is put in the initial state.

The seventh stage S7 is succeeded by the nineteenth stage S19 mentioned above when the most significant bit of the first additional signal has the logic "0" level. The logic "0" level of the first additional signal shows that the first additional signal is the particular signal PS.

The nineteenth stage S19 succeeds the seventh stage S7 and is for judging whether or not the first additional signal carries the service suspension code of the particular signal PS by the use of the arithmetic logic unit 308 in accordance with the particular program.

If the first additional signal carries the service suspension code, the ALU 308 produces a detection signal. In this case, the particular signal may be called a predetermined signal of a single word. The processor 303 controls the display driver 310 in response to the detection signal. As a result, the display driver 310 drives the display unit 18 to make the visual display indicate a predetermined message stored in the data memory 307 in response to the particular signal at a twentieth stage S20. The predetermined message may be "PAY FEE" which indicates that the owner of the radio paging receiver in question should pay the service fee as described heretobefore. The display of the message lasts until the power source switch 21 is opened.

Responsive to the particular signal PS, the particular program stored in the program memory 301 makes the processor 303 inhibit the receiving operation of the receiving section for the call signal N which is specific to the radio paging receiver under consideration and appears following the particular signal PS in the next frame of the radio signal. Such inhibition is possible, for example, by disabling the arithmetic logic unit 308.

The conventional radio paging receiver does not display the predetermined message even when the processor 303 inhibits the receiving operation of the receiving section when the power source switch 21 is opened and then closed. As a result, the owner of the receiver can not notice that the receiver is not in the receiving mode.

According to a second embodiment of the Ichikawa et al patent, the receiver comprises a destruct circuit for destructing data memorized in a PROM (programmable read only memory) which is for memorizing a call signal specific to the receiver as the data. The destruct circuit destructs the data in the PROM when the receiver receives the predetermined message mentioned above. In this event, a reception controller (CPU) of the receiver can not access the PROM. As a result, the receiver can not be put in an operation state. The receiver comprises a display for displaying a message. The display displays a predetermined message such as "PAY FEE", when the reception controller can not access the PROM.

The receiver can not judge whether or not the PROM is destructed by the destruct circuit. That is, the receiver can not judge whether or not the PROM has a trouble. As a result, the display displays the predetermined message, even though an owner of the receiver pay a service fee. In addition, the receiver can be put in the operation state unless a new PROM with storage of the call signal specific to the receiver is substituted for the PROM in which the data is destructed.

Figure 5:
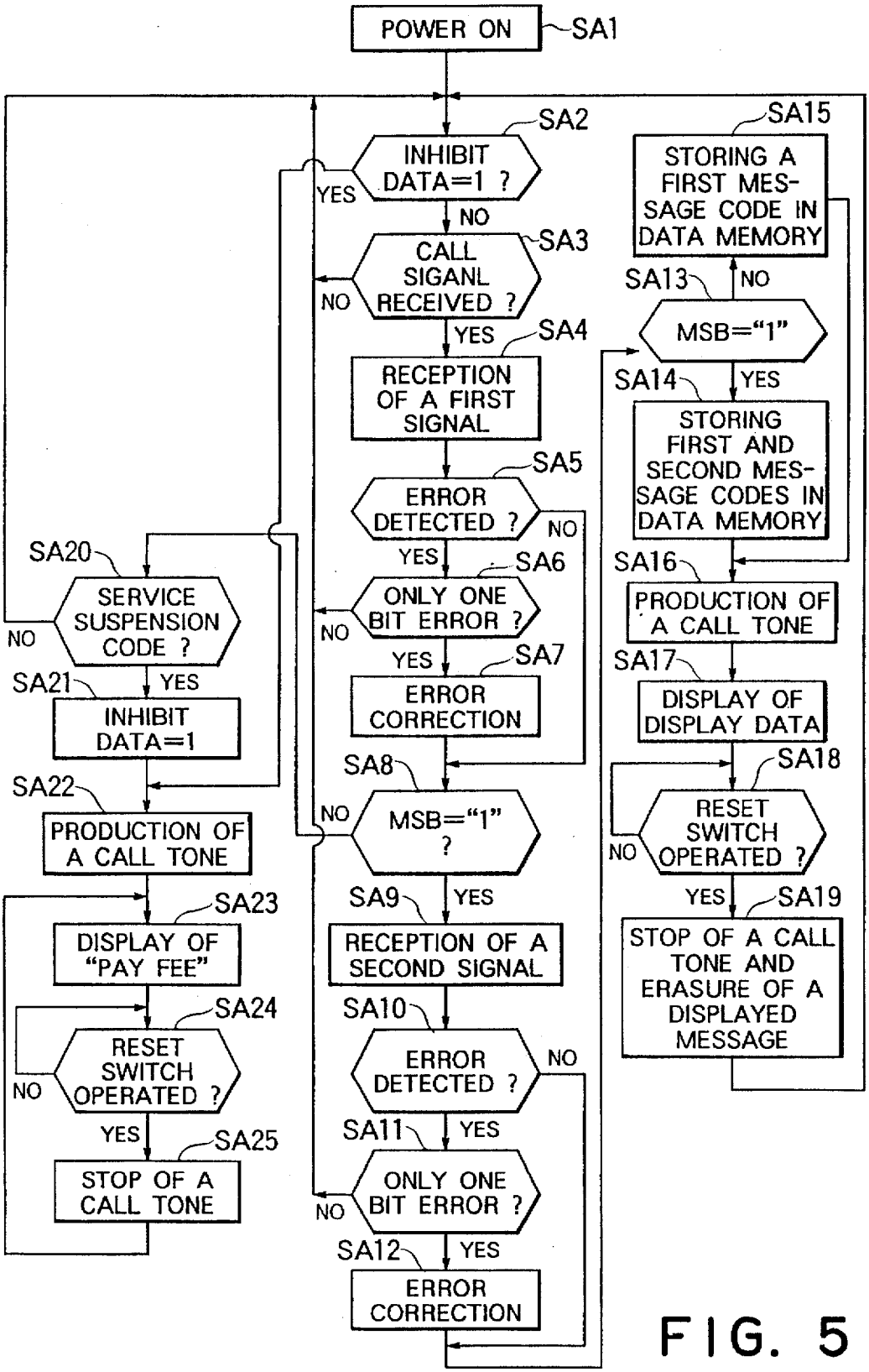
FIG. 5 is a flow chart for use in describing operation of the radio paging receiver according to an embodiment of this invention.

Referring to FIG. 5 together with FIGS. 1, 2, and 3, the description will proceed to a preferred operation of the radio paging receiver illustrated with reference to FIGS. 1 through 3.

Referring more particularly to FIG. 1, the EEPROM 15 has a memorizing area 22 for memorizing an inhibit signal as an inhibit data. The inhibit signal is produced by the processor 303 when the receiver receives the predetermined signal mentioned above. The processor 303 is not put into operation when the inhibit data has the logic "1" level except for the following operation.

The radio paging receiver is energized into an initial state when the power source switch 21 is closed at a first stage SA1. The first stage SA1 proceeds to a second stage SA2 at which operation is carried out to judge whether or not the inhibit data has the logic "1" level. When the inhibit data has not the logic "1" level, the second stage SA2 is followed by a third stage SA3. Otherwise, the second stage SA2 is followed by a twenty-second stage SA22.

The third through twentieth stages SA3 to SA20 are similar to the second through the nineteenth stages S2 to S19 described in conjunction with FIG. 4, respectively.

In the manner described in connection with FIG. 4, the twentieth stage SA20 succeeds the eighth stage SA8 and is for judging whether or not the first additional signal carries the service suspension code of the particular signal PS by the use of the arithmetic logic unit 308 in accordance with the particular program. If the first additional signal carries the service suspension code, the arithmetic logic unit 308 produces a detection signal.

In connection with FIG. 5, the processor 303 produces the inhibit signal to the EEPROM 15 in response to the detection signal. The memorizing area of the EEPROM 15 is stored with the inhibit data of the logic "1" level when supplied with the inhibit signal from the processor 303 at a twenty-first stage SA21.

Either of the second and the twenty-first stages SA2 and SA21 is followed by the twenty-second stage S22. At the twenty-second stage SA22, the processor 303 produces a drive signal as one of the control signals C. The driver circuit 16 makes the loudspeaker 17 produce the call tone in response to the drive signal which is now produced when the predetermined message is received.

At a twenty-third stage SA23, the processor 303 controls the display driver 310 in response to the detection signal. As a result, the display 18 indicates a predetermined message stored in the data memory 307 in response to the particular Signal. The predetermined message may represent "PAY FEE" which indicates that the owner of this radio paging receiver in question should pay the service fee as described heretobefore.

After the twenty-third stage SA23, a twenty-fourth stage SA24 is carried out so as to judge whether or not the reset switch 20 is closed. If the reset switch 20 is closed, the call tone is stopped at a twenty-fifth stage SA25. The display of the message lasts until the power source switch 21 opened.

The EEPROM 15 memorizes the inhibit data even after the power source switch 21 opened. The radio paging receiver displays the predetermined message when the power source switch 21 is later closed.

If the owner pays the service fee, the inhibit data can be erased from the memory area of the EEPROM 15 at the control station. The receiver is now operative until another inhibit data is stored in the memory area of the EEPROM 15.

What is claimed is:

1. A radio paging receiver operated by supply of electric power, said radio paging receiver comprising:

a power switch for directing start and stop of supplying said electric power to said radio paging receiver, a memory for memorizing a received message received by said radio paging receiver after said switch directs the start of supplying said electric power to said radio paging receiver, setting means for setting an inhibit signal into said memory when said received message is representative of a suspension of receiving operation of said radio paging receiver, judging means for judging whether said inhibit signal is set into said memory or not in response to the start of supplying said electric power to said radio paging receiver, informing means for producing a call tone and for displaying a no payment message when said judging means judges that said inhibit signal is set into said memory, and a reset switch for stopping only said call tone, said informing means stopping displaying said no payment message only when said power switch directs the stop of supplying said electric power to said radio paging receiver.

2. A radio paging receiver as claimed in claim 1, further comprising power supplying means for supplying electric power to said radio paging receiver, wherein:

said informing means is for displaying said no payment message when said inhibit signal is set into said memory and when said power supplying means supplies said power to said radio paging receiver through said power switch.

3. A radio paging receiver as claimed in claim 1, further comprising display reset means for erasing said no payment message on said informing means, wherein:

said informing means is for displaying said no payment message when said inhibit signal is set into said memory regardless of an operation of said display reset means.

* * * * *